US007389908B2

(12) United States Patent
Cohen

(10) Patent No.: US 7,389,908 B2
(45) Date of Patent: Jun. 24, 2008

(54) THREE-DIMENSIONAL DISPLAY FORM AND BLANK

(75) Inventor: Patrice Cohen, 5825 av Durocher, Outremont, QBC (CA) H2V 3Y5

(73) Assignee: Patrice Cohen, Montreal, Quebec (CA)

( * ) Notice: Subject to any disclaimer, the term of this patent is extended or adjusted under 35 U.S.C. 154(b) by 599 days.

(21) Appl. No.: 10/829,265

(22) Filed: Apr. 22, 2004

(65) Prior Publication Data

US 2005/0236464 A1 Oct. 27, 2005

(51) Int. Cl.
*B65D 5/00* (2006.01)
*B65D 21/02* (2006.01)

(52) U.S. Cl. ..... 229/116; 40/124.08; 40/312; 206/459.5; 273/157 R; 229/116.1; 229/120.01

(58) Field of Classification Search ..... 229/116, 229/116.1, 120.01; 206/459.5; 40/124.08, 40/124.14, 124.15, 124.19, 312; 273/153 P, 273/157 R See application file for complete search history.

(56) References Cited

U.S. PATENT DOCUMENTS 2,327,049 A * 8/1943 Kner ..... 446/79
2,433,663 A * 12/1947 Hanson ..... 206/459.5
2,882,990 A * 4/1959 Mustoe ..... 181/284
2,885,839 A * 5/1959 Weiss ..... 53/398
2,936,939 A * 5/1960 Lundquist ..... 229/116
3,113,673 A * 12/1963 Stein ..... 229/120.011
3,131,849 A * 5/1964 Paige ..... 229/117.16
3,306,521 A * 2/1967 Giacovas ..... 229/136
3,322,323 A * 5/1967 Greene et al. ..... 229/136
3,359,657 A * 12/1967 Hedberg ..... 434/211
3,447,733 A * 6/1969 Nelson et al. ..... 229/120.011
RE26,742 E * 12/1969 Laskow ..... 229/87.19
3,659,360 A * 5/1972 Zeischegg ..... 434/403
3,666,607 A 5/1972 Weissman
3,735,861 A * 5/1973 Wallach ..... 206/748
3,831,832 A * 8/1974 Gray ..... 229/116.4
4,064,662 A * 12/1977 O'Toole ..... 52/71
4,309,835 A 1/1982 Naeve
4,334,871 A 6/1982 Roane
4,540,612 A 9/1985 Rhyner
4,788,109 A 11/1988 Mage
4,854,060 A 8/1989 Corbo et al.
4,991,328 A 2/1991 Rousseau et al.
5,014,455 A 5/1991 Desaderata
5,364,017 A * 11/1994 Bennett ..... 229/107
5,454,180 A 10/1995 Volpe
5,489,230 A 2/1996 Gavula, Jr.
5,564,208 A * 10/1996 Bergman ..... 40/539
5,657,562 A 8/1997 Desormeaux
5,983,538 A 11/1999 Crowell
6,059,179 A * 5/2000 Giampapa ..... 229/103
6,290,119 B1 * 9/2001 Reese et al. ..... 229/4.5

(Continued)

*Primary Examiner*—Gary E Elkins

(57) ABSTRACT

A blank for constructing a three-dimensional form is provided. The blank includes a rhomboid panel with three edges and two fold lines, which define a pair of triangular panels. Another rhomboid panel connected to the first rhomboid panel along the common fold line, the other rhomboid panel having three edges and a fold line, which together with the common fold line define another pair of triangular panels. At least one securing flap is connected to one rhomboid edge, the rhomboid panels being foldable towards each other about the common fold line. The pairs of triangles are foldable towards each other and the securing flap is foldable over and connectable to one of the second rhomboid panel edges. A three-dimensional form is also provided.

2 Claims, 4 Drawing Sheets

U.S. PATENT DOCUMENTS 6,349,491 B1 2/2002 Able
6,379,212 B1 4/2002 Miller
6,431,359 B1 * 8/2002 Hollander ..... 206/459.5
2004/0046011 A1 * 3/2004 Lin ..... 229/116

* cited by examiner

THREE-DIMENSIONAL DISPLAY FORM AND BLANK

FIELD OF THE INVENTION

The present invention concerns a recreational display form, more particularly to a three-dimensional form and a blank for making the form.

BACKGROUND OF THE INVENTION

Three-dimensional forms are useful for mathematical modeling and for predicting crystal structures and such. The model forms may also be useful for recreational purposes such as toys and puzzles. Often, the forms are generated from blanks, which involve several folding and adhesion steps to produce the final form. The blanks are often of a complex design and involve folding steps that may be ergonomically disfavored. Several such designs are illustrated as follows:

U.S. Pat. No. 3,666,607, issued May 30, 1972 to Weissman for 'Blank for Construction Solid Forms'; and U.S. Pat. No. 6,379,212, issued Apr. 30, 2002 to Miller for 'System and Set of Intercleaving Dichotomized Polyhedral Elements and Extensions'.

The aforesaid designs, however, suffer from a number of disadvantages. Weissman's design includes a blank with multiple shaped flaps located on all sides of the blank. A number of slots appear to be used to connect the flaps thereinto. Disadvantageously, for the form to be constructed the slots and the flaps have to be accurately aligned, which may be difficult if one of the flaps is distorted. Moreover, manufacture of the blank may involve precision cutting to enable accurate connection of the slots and the flaps. A number of rubber bands are required to hold the form together by a complicated interconnection to a number of panel slits and which would require a high level of manual dexterity, which may be inappropriate for children. Miller's design appears to be designed for interfitting multiple elements and involves the use of a complex template with multiple folds. The form, once constructed is a polyhedral with filleted edges, clefts and webbing, which appear to be used for interfitting the forms, and may be inappropriate for displaying images thereon.

Thus there is a need for an improved three dimensional form for displaying images.

SUMMARY OF THE INVENTION

The present invention reduces the difficulties and disadvantages of the previous designs by providing a novel blank that is used to make a three-dimensional form. The blank is made of a collectable recreational card, such as hockey or football cards and the like, and includes a novel arrangement of folds and images, so that a user can quickly and easily construct the form. Advantageously, the form can be assembled using ergonomically favorable folding movements and using simple adhesive strips to maintain the form. Multiple forms can be fitted together to form a polyhedral display form on which a user can display multiple favorite sporting figure images, teams images and the like. This is advantageously achieved without the need for complex design features. For additional versatility, the form may also be used as an education tool such as a puzzle, which may aid the development of color and pattern recognition skills. The blank is of a simple design, which does not require precision cutting and is manufactured using inexpensive and readily available starting materials such as cardboard. Moreover, securing flaps are located on only a select number of blank edges and are merely folded over to enable construction of the form.

According to an aspect of the present invention, there is provided a three-dimensional display form, the display form comprising:

a polyhedron defining a plurality of faces thereof and including a plurality of three dimensional forms being fitted together, each said three dimensional form including;

a first rhomboid panel having first, second and third edges a first fold line and a second fold line, the first and second fold lines definin a first pair of triangular panels;

a second rhomboid panal connected to the first rhomboid panel along the second fold line, the second rhomboid panel having first, second and third edges and a third fold line, the third fold line and the second fold line defining a second pair of triangular panels;

at least one securing flap connected to one of the first rhomboid panel edges, the first and second rhomboid panels being folded towards each other about the second fold line, the first pair of triangular panels being folded towards each about the first fold line, the second pair of triangular panels being folded towards each other about the third fold line, the securing flap being folded over and connected to one of the second rhomboid panel edges: and a securing media connected to at least one of the triangular panels for selective adherence to a corresponding triangular panel of an adjacent form;

at least two of said triangular panels of a respective said three dimensional form has an image thereon, with said respective three dimensional form being made from a collectable recreational card;

each face of the polyhedron being one of said triangular panels of a respective said three dimensional form having an image thereon; and each said three dimensional form being relesably connected to an adjacent said three dimensional foam of said polyhedron using corresponding said securing media thereof, so as to be re-orientable relative to adjacent said forms between at least first and second configurations of said polyhedron, said first configuration being defined by each face of the polyhedron having one respective said image portions thereon with said image portions forming a complete image with said complete image extending over an entire surface of said polyhedron, and said second configuration being defined by each face of the polyhedron having one respective said recreational image thereon.

According to another aspect of the present invention, there is provided a recreational kit, the kit comprising: a plurality of recreational cards, as described above; and instructions for folding the recreational card.

BRIEF DESCRIPTION OF THE DRAWINGS

Further aspects and advantages of the present invention will become better understood with reference to the description in association with the following Figures, in which.

DETAILED DESCRIPTION OF THE PREFERRED EMBODIMENT

Figure 1:
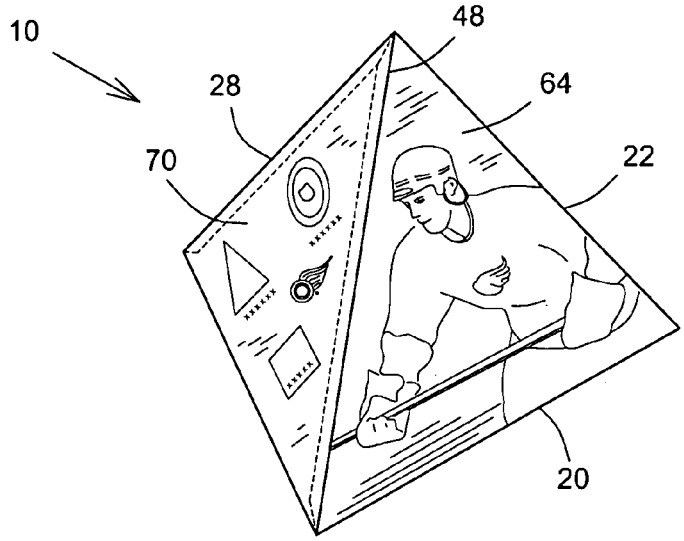
FIG. 1 is a perspective view of a three-dimensional form.

Referring now to FIGS. 1, 2, 2*a* and 2*b*, a three dimensional display form of the present invention is shown generally at 10, which is constructed from a blank 12. The blank 12 is a single sheet of material, which is typically cardboard, although any suitable durable material may be used without deviating from the scope of the present invention. In the embodiment of the present invention, the blank 12 is a collectable recreational card, such as a hockey card or a football card and the like. The blank 12 is generally rhomboid and is divided into two rhomboid panels 14, 16 by a fold line 18. The two rhomboid panels 14, 16 are of generally equal dimensions.

The first rhomboid panel 14 has a first edge 17, a second edge 18 and a third edge 20. Another fold line 22 bisects the panel 14 and the together with the fold line 18, divides the first rhomboid panel 14 into two triangular panels 24, 26.

The second rhomboid panel 16 is connected to the first rhomboid panel 14 along the fold line 18. The second rhomboid panel 16 includes first, second and third side edges 28, 30, and 32. A third fold line 34 bisects the panel 16 and together with the fold line 18, defines a second pair of triangular panels 36, 38.

A first securing flap 40, a second securing flap 42 and a third securing flap 44 are connected respectively to the first, second and third edges 17, 18, 20 of the first rhomboid panel 14. Although three securing flaps are illustrated in this embodiment, it is to be understood that one or two securing flaps located on one of the rhomboid panels would also work without deviating from the scope of the invention. The first, second and third securing flaps 40, 42, 44 include respective first, second and third flap fold lines 46, 48, 50 along the first, second and third edges 17, 18, 20 of the first rhomboid panel 14. Typically, the first, second, and third edges 17, 18, 20 and the three side edges 28, 30, and 32 are substantially equal in length. Each of the securing flaps 40, 42, 44 includes a first securing flap edge 52, a second securing flap edge 54 and a third securing flap edge 56.

Typically, the first and second securing flap edges 52, 54 are shorter than the third securing flap edge 56. The first and second securing flap edges 52, 54 are angled inwardly towards each other such that when the blank 12 is laid on a flat surface, the second securing flap edge 54 of the second securing flap 42 and the first securing flap edge 52 of the third securing flap 44 define an obtuse angle 58 therebetween. The first securing flap edge 52 of the first securing flap 40 and the second securing flap edge 54 of the second securing flap 44 extend to an intersection 60 therebetween so that the first and second securing flap edges 52, 54 form a linear edge portion 62. Typically, the securing flaps 42, 44, 46 have substantially equal width. The fold lines 18, 22, 34 are substantially of equal length and define the triangular panels which are four equilateral triangles 24, 26, 36, 38.

In an important aspect of the present invention, images 64, 66, 68, 70 are adhered to each of the triangular panels 24, 26, 36, 38. Typically, the images are part of a single sheet of image material, which are secured to the surface of the card. The images 64, 66, 68, 70 maybe complete recreational images such as sporting figures or they may be a portion of an image. The images may have a picture of a sporting figure and information such as player statistics thereon. The images 64, 66, 68, 70 may each be different, which increases the versatility of the three-dimensional form 10.

In the embodiment illustrated, the images 64, 66, 68, 70 are located on one side of the sheet 72, the other side 74 being blank. The blank side of the sheet 74, once the form is constructed faces the inner void of the form 10. One skilled in the art will recognize that both sides of the blank can be covered with an image or portions of an image. This alternative feature increases the versatility of the display form.

Figure 2:
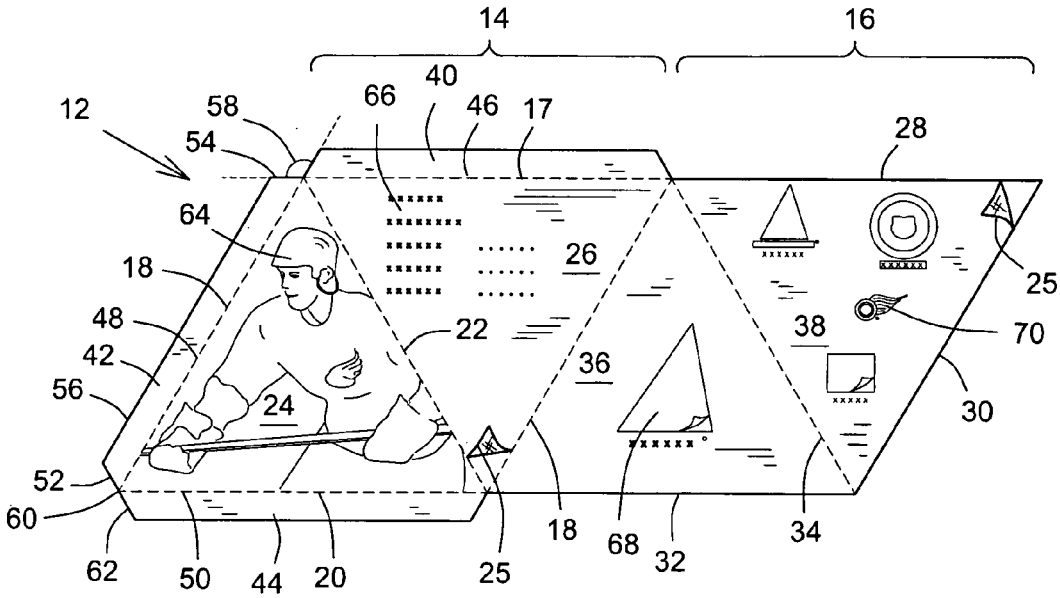
FIG. 2 is a top view of a blank for making the form.
Figure 2A:
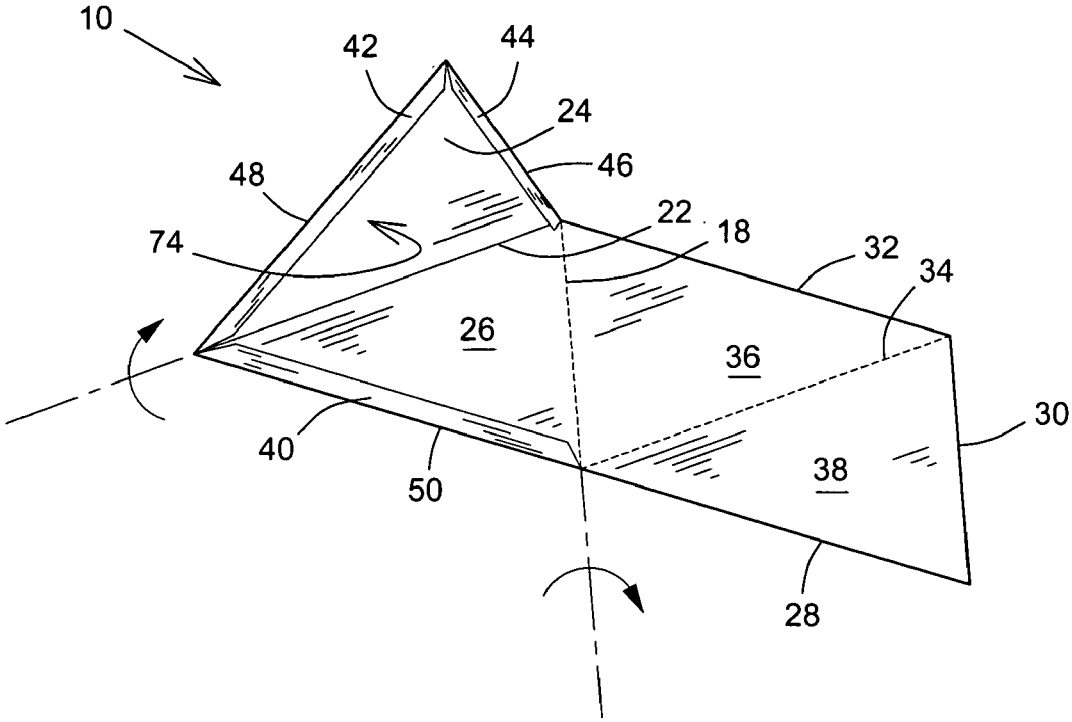
FIG. 2*a* is a perspective view of the blank during folding.
Figure 2B:
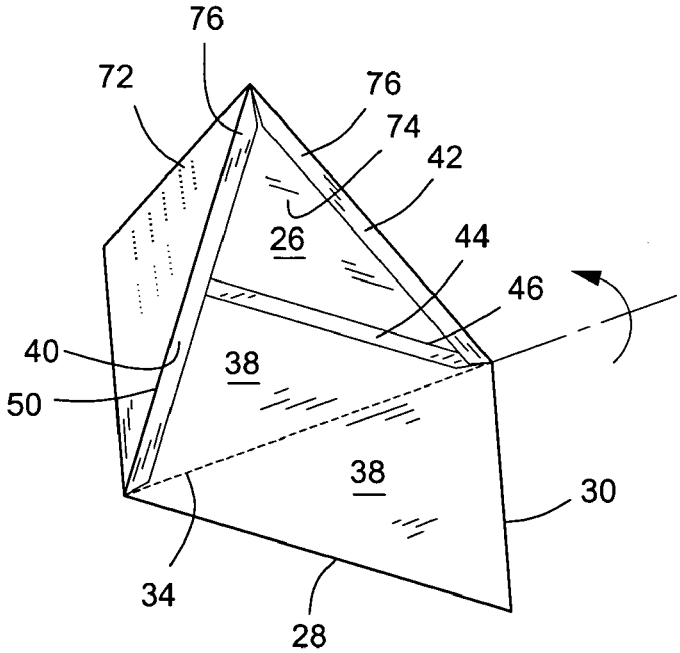
FIG. 2*b* is a perspective view of blank with a triangular panel folded away.

As best illustrated in FIG. 2, a piece of transparent adhesive material 25 may be attached to the triangular panel 26 or the triangular panel 38, which if peeled off reveals an adhesive surface (not illustrated) which may itself include an image thereon or may include additional recreational features such as stickers and the like.

Adhesive strips 76 are connected to each of the securing flaps 42, 44, 46 along substantially the entire length thereof. In the embodiment illustrated, the adhesive strips 76 are protected by a removable strip (not shown), which is removed before the form 10 is assembled. One skilled in the art will recognize that although adhesive strips are used, other types of securing media, such as VELCRO™, magnetic strips and the like could be used without deviating from the scope of the invention. Moreover, the adhesive strips 76 may be used to temporarily construct the three-dimensional form 10 such that after the user is finished displaying the images, the form 10 can be dismantled quickly and easily, to enable transport without excessive bulk. The adhesive strips 76 connect the securing flaps 40, 42, 44 to the respective side edges 28, 30, and 32 of the second rhomboid panel 16. One skilled in the art will recognize that if one securing flap is present on the first rhomboid panel 14 of the blank 10, it connects to one of the side edges of the second rhomboid panel 16.

The first and second rhomboid panels 14,16 are folded about the fold line 18 towards each other so that the panels 14, 16 are generally orthogonal to each other. The three securing flaps 42,44, 46 are folded inwardly about their fold lines and the first, second and third edges 17, 18, 20 and are positioned generally orthogonal to their respective rhomboid panels 14, 16. The securing flaps 42, 44, 46 are folded towards the side edges 28, 30, 32 of the second rhomboid panel 16. The second pair of triangles are folded about the third fold line, so that first, second and third securing flaps 42, 24, 46 are adhered, using the adhesive strips 76 to the side edges 28, 30, and 32 of the second rhomboid panel 16. Once constructed, the form 10 includes the four triangular panels with the images facing outwardly of the form 10.

Figure 3:
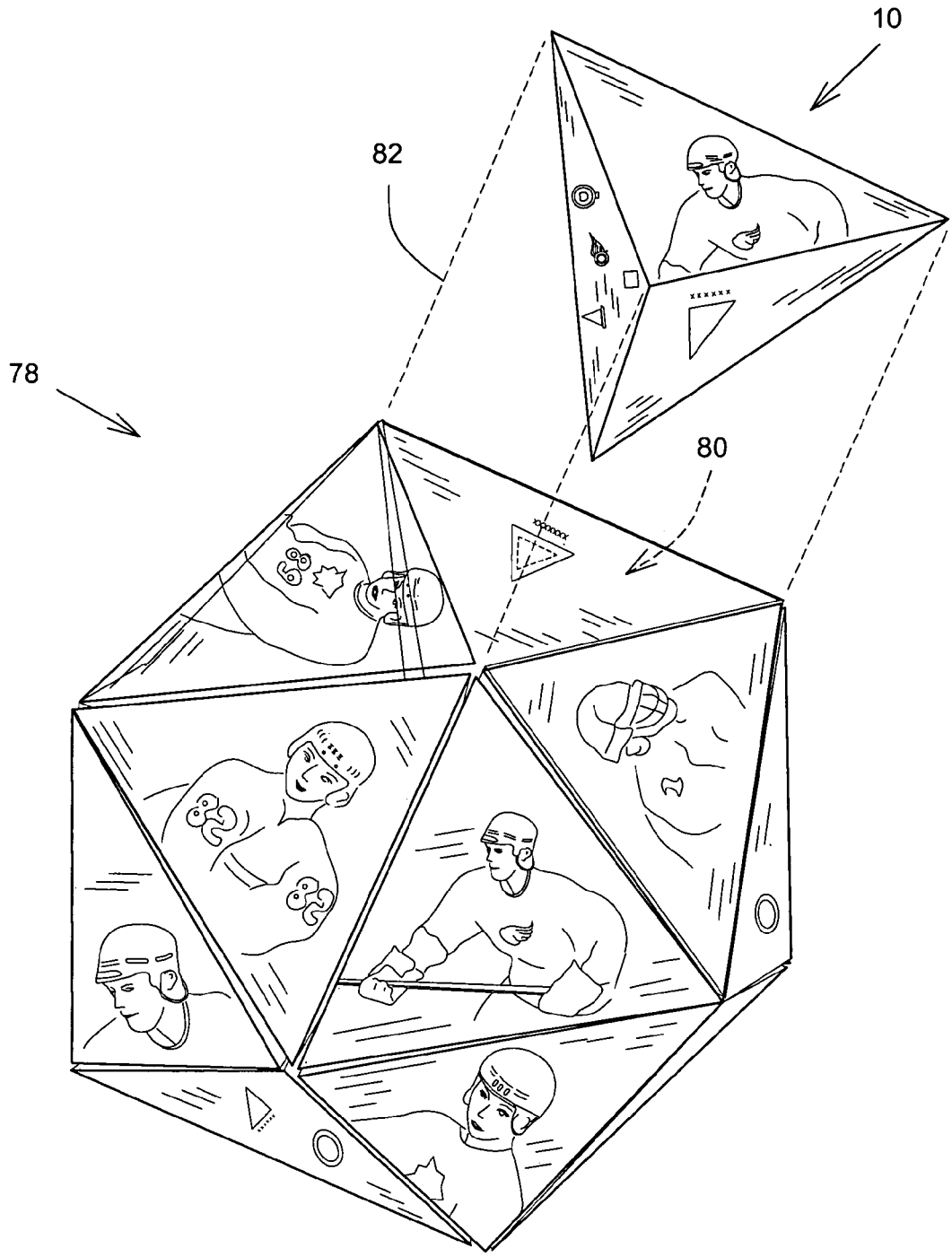
FIG. 3 is a perspective view of a partially constructed polyhedral form.
Figure 3A:
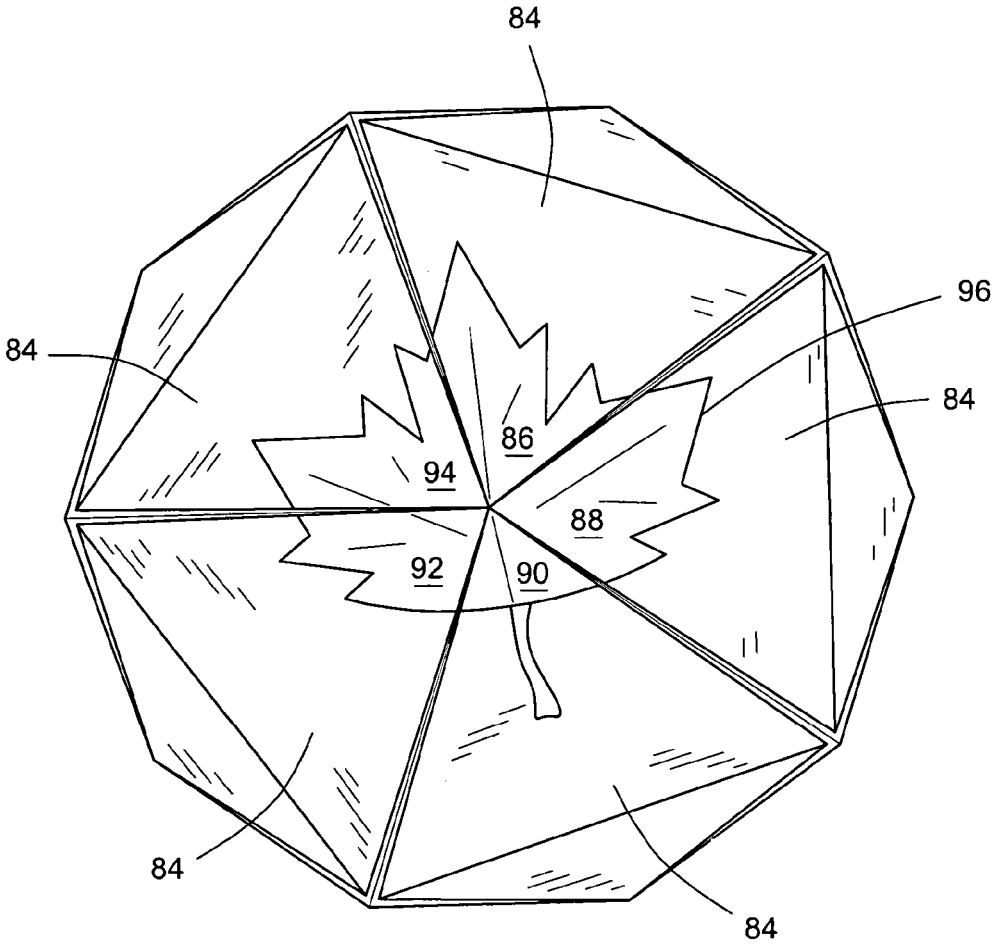
FIG. 3*a* is a top view of the polyhedral form showing a completed image.

Referring now to FIGS. 3 and 3*a*, the user, if he collects a number of recreational cards, can generate multiple forms, which themselves can be fitted together to form a three-dimensional polyhedron 78. In the embodiment illustrated, the polyhedron 78 is an Icosahedron. The polyhedron 78 may be constructed by sequentially adding forms 10 until, as illustrated In FIG. 3, the final form 10 is added into a polyhedral void 80 along the lines 82. The forms 10 of the polyhedron 78 are held together by an interference fit, which enables quick and easy construction and disassembly. Each face of the Icosahedron includes one of the images 64, 66, 68, 70 from the forms 10; the images can be interchanged by altering the positioning of the form in the Icosahedron. If desired, image portions 86, 88, 90, 92, 94 of a larger image 96, can be arranged such that when the Icosahedron is constructed, the completed image 96 can be displayed on at least five adjacent faces 84 of the Icosahedron having a common vertices, as shown In FIG. 3*a*, or eventually on all faces.

Referring now to FIGS. 3 and 3*a*, the user, if he collects a number of recreational cards, can generate multiple forms, which themselves can be fitted together to form a three-dimensional polyhedron 78. The polyhedron 78 may be constructed by sequentially adding forms 10 until, as illustrated in FIG. 3, the final form 10 is added into a polyhedral void 80 along the lines 82. The forms 10 of the polyhedron 78 are held together by an interference fit, which enables quick and easy construction and disassembly. Each face of the polyhedron includes one of the images 64, 66, 68, 70 from the forms 10; the images can be interchanged by altering the positioning of the form in the polyhedron. If desired, image portions 86, 88, 90, 92, 94 of a larger image 96, can be arranged such that when the polyhedron is constructed, the completed image 96 can be displayed on at least five adjacent faces 84 of the polyhedron having a common vertices, as shown in FIG. 3*a*, or eventually on all faces.

The blank 10 of the present invention may also be used in kit form together with an instructions sheet for folding the blank 12 to produce the form 10. The kit may include one or many cards, which the collector collects and may be used to construct the polyhedron 78.

While a specific embodiment has been described, those skilled in the art will recognize many alterations that could be made within the spirit of the invention, which is defined solely according to the following claims.

I claim:

1. A three dimensional display form, the display form comprising:

a polyhedron defining a plurality of faces thereof and including a plurality of three dimensional forms being fitted together, each said three dimensional form including:

a first rhomboid panel having first, second and third edges, a first fold line and a second fold line, the first and second fold lines defining a first pair of triangular panels;

a second rhomboid panel connected to the first rhomboid panel along the second fold line, the second rhomboid panel having first, second and third edges and a third fold line, the third fold line and the second fold line defining a second pair of triangular panels;

at least one securing flap connected to one of the first rhomboid panel edges, the first and second rhomboid panels being folded towards each other about the second fold line, the first pair of triangular panels being folded towards each about the first fold line, the second pair of triangular panels being folded towards each other about the third fold line, the securing flap being folded over and connected to one of the second rhomboid panel edges; and a securing media connected to at least one of the triangular panels for selective adherence to a corresponding triangular panel of an adjacent form;

at least two of said triangular panels of a respective said three dimensional form has an image thereon, with said respective three dimensional form being made from a collectable recreational card;

each face of the polyhedron being one of said triangular panels of a respective said three dimensional form having an image thereon; and each said three dimensional form being relesably connected to an adjacent said three dimensional form of said polyhedron using corresponding said securing media thereof, so as to be re-orientable relative to adjacent said forms between at least first and second configurations of said polyhedron, said first configuration being defined by each face of the polyhedron having one respective said image portions thereon with said image portions forming a complete image with said complete image extending over an entire surface of said polyhedron, and said second configuration being defined by each face of the polyhedron having one respective said recreational image thereon.

2. A recreational kit, the kit comprising:

a plurality of recreational cards, according to claim 1; and instructions for folding the recreational card.

* * * * *